US010191400B2

(12) United States Patent
Fujisaki et al.

(10) Patent No.: US 10,191,400 B2
(45) Date of Patent: Jan. 29, 2019

(54) TONER FOR ELECTROSTATIC CHARGE IMAGE DEVELOPMENT

(71) Applicant: Konica Minolta, Inc., Tokyo (JP)

(72) Inventors: Tatsuya Fujisaki, Hino (JP); Junichi Furukawa, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/875,675

(22) Filed: Jan. 19, 2018

(65) Prior Publication Data

US 2018/0217517 A1 Aug. 2, 2018

(30) Foreign Application Priority Data

Feb. 2, 2017 (JP) ..... 2017-017277

(51) Int. Cl.
*G03G 9/08* (2006.01)
*G03G 9/087* (2006.01)

(52) U.S. Cl.
CPC ..... *G03G 9/08797* (2013.01); *G03G 9/0821* (2013.01); *G03G 9/0823* (2013.01); *G03G 9/08711* (2013.01)

(58) Field of Classification Search
CPC ..... G03G 9/0821; G03G 9/0823; G03G 9/08711; G03G 9/08755
USPC ..... 430/111.41, 111.4
See application file for complete search history.

(56) References Cited

FOREIGN PATENT DOCUMENTS

JP 2007086494 A 4/2007

*Primary Examiner* — Mark A Chapman
(74) *Attorney, Agent, or Firm* — Lucas & Mercanti, LLP

(57) ABSTRACT

A toner for electrostatic charge image development includes toner base particles including at least a binder resin, has a volume resistivity of $1.0\times10^{14}$ Ω·cm or more at 25° C. with 50% RH by a temperature change method, and has a volume resistivity of $1.0\times10^{15}$ Ω·cm or less at 67° C. by the temperature change method.

8 Claims, 2 Drawing Sheets

TONER FOR ELECTROSTATIC CHARGE IMAGE DEVELOPMENT

The entire disclosure of Japanese patent Application No. 2017-017277, filed on Feb. 2, 2017, is incorporated herein by reference in its entirety.

BACKGROUND

Technological Field

The present invention relates to a toner for electrostatic charge image development. More specifically, the present invention relates to a toner for electrostatic charge image development, which contains a crystalline resin but has favorable chargeability, and further can suppress the occurrence of electrostatic offset.

Description of the Related Art

When a crystalline substance is contained in toner base particles in order to improve the low temperature fixability, the volume resistivity decreases, and the toner chargeability tends to deteriorate.

In response to such a problem, a method of defining the volume resistivity at room temperature and the like is known (see, for example, JP 2007-86494 A).

Herein, in the production print field, there are many cases where an image of a poster or the like, to which a large amount of toner adheres is output to the entire paper and both surfaces. In such a case, a problem that images and paper sheets are electrostatically stuck at the time of paper discharge (hereinafter, also referred to as "electrostatic offset") tends to become apparent.

Hereinafter, with reference to FIG. 1, a mechanism for generating electrostatic offset will be described.

FIG. 1 is an overall configuration view of an electrophotographic image forming apparatus (hereinafter, may also be simply referred to as "image forming apparatus") X using a general electrophotographic image forming method.

The image forming apparatus X is configured with an image forming apparatus main body GH and an image reading unit YS. The image forming apparatus main body GH is configured with multiple sets of image forming units 10Y, 10M, 10C, and 10K, a belt-shaped intermediate transfer belt 5, a paper sheet feed conveyance unit, a fixing device 8, and the like. The fixing device 8 heats and pressurizes a toner image of a sheet P at a nip part formed between a heated fixing belt 81 and a pressure roller 84 to fix the toner image.

In the above-described general electrophotographic image forming apparatus X, in the case of outputting images on both surfaces, by a transfer current at the time of transferring an image to the second surface (back surface) (hereinafter, also referred to as "back surface image"), electric charge is accumulated in the image fixed on the first surface (front surface) (hereinafter, also referred to as "front surface image") in advance. In general, the electric charge leaks due to the contact between the front surface image and the pressure roller 84 at the time of fixing the back surface image.

However, in a case where sufficient heat is not applied to the front surface image at the time of fixing the back surface image, the electric charge remains on the front surface image, and as a result, paper sheets stick to each other via the back surface image and the front surface image on a paper discharge tray. For example, in the technique described in JP 2007-86494 A, there is a problem that the volume resistivity on heating is high and electrostatic offset occurs.

SUMMARY

The present invention has been made in view of the above problems and situations, an object thereof is to provide a toner for electrostatic charge image development, which contains a crystalline resin but has favorable chargeability, and further can suppress the occurrence of electrostatic offset.

To achieve the abovementioned object, according to an aspect of the present invention, a toner for electrostatic charge image development reflecting one aspect of the present invention comprises toner base particles including at least a binder resin, has a volume resistivity of $1.0\times10^{14}$ Ω·cm or more at 25° C. with 50% RH by a temperature change method, and has a volume resistivity of $1.0\times10^{15}$ Ω·cm or less at 67° C. by the temperature change method.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
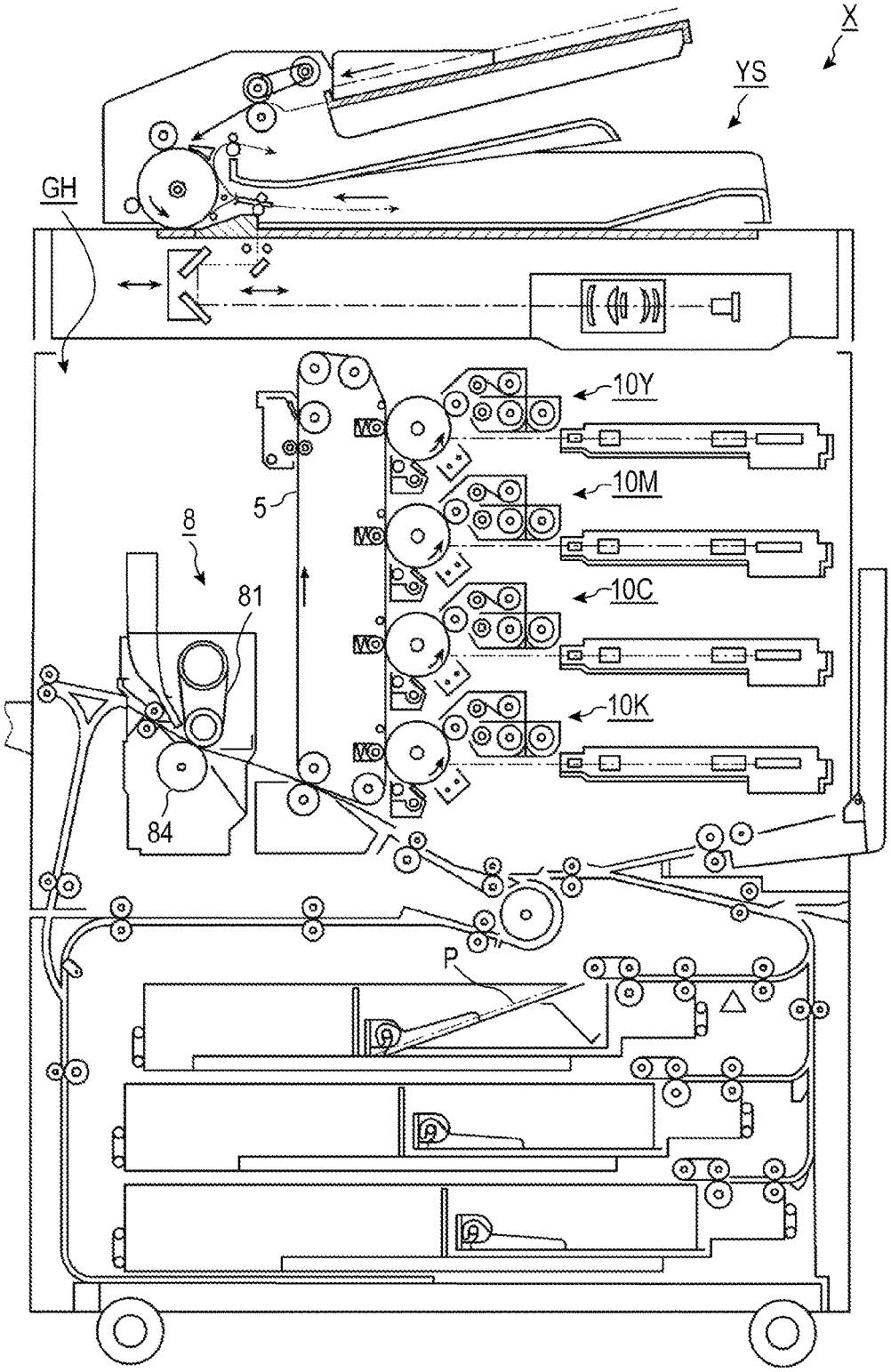
FIG. 1 is a schematic sectional view of a general electrophotographic image forming apparatus.

Hereinafter, one or more embodiments of the present invention will be described with reference to the drawings. However, the scope of the invention is not limited to the disclosed embodiments.

The toner for electrostatic charge image development of the present invention is a toner for electrostatic charge image development, containing toner base particles including at least a binder resin, which is characterized by having a volume resistivity of $1.0\times10^{14}$ Ω·cm or more at 25° C. with 50% RH by a temperature change method, and further, having a volume resistivity of $1.0\times10^{15}$ Ω·cm or less at 67° C. by the temperature change method. This characteristic is a technical feature common or corresponding to the invention according to each claim. In this way, in the present invention, an effect that the toner for electrostatic charge image development contains a crystalline resin but has favorable chargeability, and further can suppress the occurrence of electrostatic offset can be obtained.

As an embodiment of the present invention, it is preferred that the toner base particles contain a crystalline substance. In this way, the volume resistivity when heated more can be suitably lowered.

As an embodiment of the present invention, it is preferred that the toner base particles contain a release agent. In this way, the effect of the invention of the present application can be more suitably exerted.

As an embodiment of the present invention, it is preferred that the toner for electrostatic charge image development contains a crystalline polyester resin as the crystalline substance. In this way, the volume resistivity in a heated state can also be lowered, therefore, the volume resistivity can be suitably adjusted, and eventually the effect of the invention of the present application can be more suitably exerted.

As an embodiment of the present invention, it is preferred that the toner for electrostatic charge image development contains an ester-based wax as the release agent. In this way, the volume resistivity can be suitably adjusted, and the effect of the invention of the present application can be more suitably exerted.

As an embodiment of the present invention, it is preferred that the toner for electrostatic charge image development contains a styrene-acrylic resin as the binder resin. In this way, the occurrence of electrostatic offset can be more suppressed, and further, the chargeability can be suitably achieved.

As an embodiment of the present invention, it is preferred that the crystalline polyester resin is contained in the toner base particles within the range of 1 to 20% by mass. In this way, the occurrence of electrostatic offset can be more suppressed, and further, the chargeability can be suitably achieved.

As an embodiment of the present invention, it is preferred that the content of sulfur element (S) as measured by X-ray analysis is within the range of 0.2 to 0.7 at %. In this way, the volume resistivity can be suitably achieved, and the occurrence of electrostatic offset can be more suppressed.

Hereinafter, the present invention and the constituent elements, and the embodiments and modes for carrying out the present invention will be described in detail. Note that in the present application, the expression "to" is used with the meaning of including the numerical values described before and after the "to" as the lower limit value and the upper limit value, respectively.

<<Overview of Toner for Electrostatic Charge Image Development>>

The toner for electrostatic charge image development of the present invention is a toner for electrostatic charge image development, containing toner base particles including at least a binder resin, which is characterized by having a volume resistivity of $1.0\times10^{14}$ Ω·cm or more at 25° C. with 50% RH by a temperature change method, and further, having a volume resistivity of $1.0\times10^{15}$ Ω·cm or less at 67° C. by the temperature change method.

Note that the toner for electrostatic charge image development (hereinafter, may also be simply referred to as "toner") according to the present invention is constituted to contain at least toner particles.

Further, in the present invention, the expression "toner" is referred to as an aggregate of "toner particles".

The toner particles are referred to as "toner base particles themselves" or "toner base particles to which external additives are added". Note that in general, it is preferred to use the "toner base particles to which external additives are added" as toner particles.

<Volume Resistivity by Temperature Change Method>

The temperature change method according to the present invention is a method of measuring the volume resistivity while raising the temperature (at the temperature rise rate of 5 to 6° C./min).

As to the volume resistivity according to the present invention, specifically, for example, with a high resistance measurement device 5451 (manufactured by ADC CORPORATION), the volume resistivity at 25° C. with 50% RH and the volume resistivity at 67° C. can be measured respectively by obtaining the behavior of the volume resistivity for the temperature from 25° C. (with the humidity of 50% RH) to 100° C.

<Content of Sulfur Element (S) as Measured by X-Ray Analysis>

If the residual amount of an activator (the amount of S in ESCA) on the surfaces of the toner base particles is small, it can be avoided that the volume resistivity becomes extremely low due to moisture absorption. From the viewpoint described above, it is preferred that in the toner for electrostatic charge image development of the present invention, the content of sulfur element (S) as measured by X-ray analysis is within the range of 0.2 to 0.7 at %. When the content is 0.2 at % or more, the volume resistivity at 67° C. does not become excessively high, and the occurrence of electrostatic offset can be more suppressed. When the content is 0.7 at % or less, the volume resistivity at 25° C. with 50% RH does not become excessively low, and the chargeability can be favorably achieved.

In order to be within the range described above, it is preferred to add an activator to control the aggregation step, and to control the number of times of washing in the washing step and the residual amount of the activator at the pH in the washing step.

(X-Ray Analysis)

The X-ray analysis can be performed by a known method. Specifically, for example, using an X-ray photoelectron spectrometer ESCA-1000 (manufactured by Shimadzu Corporation), the area ratio of the elements being present on the surface is measured.

[Toner Base Particles]

The toner base particles used in the present invention include at least a binder resin. Further, the toner base particles may contain components that constitute the common toner, such as magnetic powder and a charge control agent in addition to a release agent and a crystalline substance. Furthermore, it is preferred that the toner base particles used in the present invention are obtained by a wet production method (for example, an emulsion aggregation method or the like) in which preparation is performed in an aqueous medium.

<Binder Resin>

As the binder resin, an amorphous resin and a crystalline polyester resin can be contained.

The mass ratio of the amorphous resin to the crystalline polyester resin contained in the toner base particles according to the present invention (amorphous resin/crystalline polyester resin) is preferably within the range of 99/1 to 80/20, and more preferably within the range of 95/5 to 85/15. By specifying the amount of the crystalline polyester resin, the volume resistivity can be easily controlled to a more preferable range.

(Amorphous Resin)

The amorphous resin is not particularly limited, and an amorphous resin that is conventionally known in the present technical field can be used, however, in particular, the amorphous resin preferably contains an amorphous vinyl-based resin. When the amorphous resin contains a vinyl-based resin, a toner excellent in the plasticity at the time of heat fixing can be provided.

Herein, the expression "vinyl-based resin" is referred to as a resin obtained by polymerization using at least a vinyl-based monomer.

Specific examples of the amorphous vinyl-based resin include an acrylic resin, and a styrene-acrylic resin (hereinafter, also referred to as "St-Ac"). Among them, as the amorphous vinyl-based resin, a styrene-acrylic resin formed by using a styrene-based monomer and a (meth)acrylic acid ester-based monomer is preferred. In general, in the case of the styrene-acrylic resin, the chargeability is not high, and the occurrence of electrostatic offset can be more suitably suppressed.

In the case of using the styrene-acrylic resin, the proportion of the styrene-acrylic resin is preferably within the range of 55 to 85% by mass of the whole toner, and more preferably within the range of 60 to 80% by mass. By adjusting within this range, the volume resistivity of the toner can be controlled.

As the vinyl-based monomer forming an amorphous vinyl-based resin such as a styrene-acrylic resin, one kind or two or more kinds selected from the following ones can be used.

(1) Styrene-Based Monomer

Examples of the styrene-based monomer include styrene, o-methyl styrene, m-methyl styrene, p-methyl styrene, α-methyl styrene, p-phenyl styrene, p-ethyl styrene, 2,4-dimethyl styrene, p-tert-butyl styrene, p-n-hexyl styrene, p-n-octyl styrene, p-n-nonyl styrene, p-n-decyl styrene, p-n-dodecyl styrene, and a derivative thereof.

(2) (Meth)Acrylic Acid Ester-Based Monomer

Examples of the (meth)acrylic acid ester-based monomer include methyl (meth)acrylate, ethyl (meth)acrylate, n-butyl (meth)acrylate, isopropyl (meth)acrylate, isobutyl (meth) acrylate, t-butyl (meth)acrylate, n-octyl (meth)acrylate, 2-ethylhexyl (meth)acrylate, stearyl (meth)acrylate, lauryl (meth)acrylate, phenyl (meth)acrylate, diethylaminoethyl (meth)acrylate, dimethylaminoethyl (meth)acrylate, and a derivative thereof.

(3) Vinyl Ester-Based Monomer

Examples of the vinyl ester-based monomer include vinyl propionate, vinyl acetate, and vinyl benzoate.

(4) Vinyl Ether-Based Monomer

Examples of the vinyl ether-based monomer include vinylmethyl ether, and vinylethyl ether.

(5) Vinyl Ketone-Based Monomer

Examples of the vinyl ketone-based monomer include vinylmethyl ketone, vinylethyl ketone, and vinylhexyl ketone.

(6) N-Vinyl-Based Monomer

Examples of the N-vinyl-based monomer include N-vinyl carbazole, N-vinyl indole, and N-vinyl pyrrolidone.

(7) Others

As other kinds of monomers, vinyl compounds such as vinylnaphthalene, and vinyl pyridine, an acrylic acid or methacrylic acid derivative, such as acrylonitrile, methacrylonitrile, and acrylamide, and the like can be used.

Further, as the vinyl-based monomer, for example, a monomer having an ionic dissociation group such as a carboxyl group, a sulfonic acid group, or a phosphoric acid group is preferably used. Specifically, the following ones can be mentioned.

Examples of the monomer having a carboxyl group include acrylic acid, methacrylic acid, maleic acid, itaconic acid, cinnamic acid, fumaric acid, maleic acid monoalkyl ester, and itaconic acid monoalkyl ester. Further, examples of the monomer having a sulfonic acid group include styrenesulfonic acid, allylsulfosuccinic acid, and 2-acrylamide-2-methylpropanesulfonic acid. Moreover, example of the monomer having a phosphonic acid group includes acid phosphoxyethyl methacrylate.

In addition, by using polyfunctional vinyls as the vinyl-based monomer, the amorphous vinyl-based resin can also be made into an amorphous vinyl-based resin having a crosslinked structure. Examples of the polyfunctional vinyls include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, and neopentyl glycol diacrylate.

As the preferred embodiment of the amorphous resin, the vinyl-based resin has been described in detail, however, an amorphous polyester resin may be contained in the amorphous resin.

The glass transition point ($T_g$) of the amorphous resin is preferably within the range of 40 to 70° C., and more preferably within the range of 45 to 65° C. When the glass transition point of the amorphous resin is within the range, both of satisfactory low-temperature fixability and heat-resistant storability can be achieved.

Note that the glass transition point ($T_g$) of the amorphous resin is a value measured by using "Diamond DSC" (manufactured by PerkinElmer, Inc.).

As the measurement procedure, 3.0 mg of a measurement sample (amorphous resin) is sealed in a pan made of aluminum, and the pan is set in a holder. As the reference, an empty pan made of aluminum is used. As the measurement conditions, the temperature control of Heat-cool-Heat is performed at a measurement temperature in the range of 0 to 200° C. at a temperature rise rate of 10° C./min, and a temperature drop rate of 10° C./min, analysis is conducted based on the data in the 2nd. Heat, an extension line of the baseline before the rise of the first endothermic peak, and a tangent line showing the maximum inclination between the rising part and peak apex of the first peak, are drawn, and the intersection point is taken as the glass transition point.

In addition, the molecular weight of the amorphous resin as measured by gel permeation chromatography (GPC) is preferably within the range of 10000 to 100000 in weight average molecular weight (Mw). In the present invention, the molecular weight of the amorphous resin by GPC is a value measured as follows. That is, using a device "HLC-8120 GPC" (manufactured by TOSOH CORPORATION) and a column "TSK guard column+TSKgel Super HZM-M 3 series" (manufactured by TOSOH CORPORATION), tetrahydrofuran (THF) is flowed as a carrier solvent at a flow rate of 0.2 mL/min while maintaining the column temperature at 40° C., and the measurement sample (amorphous resin) is dissolved in the tetrahydrofuran so as to be a concentration of 1 mg/mL under the dissolving conditions in which the treatment is performed at room temperature for 5 minutes by using an ultrasonic disperser, subsequently, the resultant mixture is treated with a membrane filter having a pore size of 0.2 μm to obtain a sample solution, 10 μL of this sample solution is injected into a device together with the carrier solvent, the detection is performed using a refractive index detector (RI detector), and using the calibration curve obtained by measuring the molecular weight distribution of the measurement sample with monodisperse polystyrene standard particles, the calculation is performed. Ten polystyrene samples are used for the calibration curve measurement.

[Crystalline Polyester Resin]

The expression "crystalline polyester resin" is referred to as a resin having a definite endothermic peak but not stepwise endothermic change in differential scanning calorimetry (DSC) among the known polyester resins obtained by polycondensation reaction of divalent or higher carboxylic acid (polyvalent carboxylic acid) with divalent or higher alcohol (polyhydric alcohol). The distinct endothermic peak specifically means a peak in which the half-value width of the endothermic peak is within 15° C. when measured at a temperature rise rate of 10° C./min in differential scanning calorimetry (DSC).

The polyvalent carboxylic acid is a compound containing two or more carboxy groups in one molecule. Specific examples of the polyvalent carboxylic acid include a saturated aliphatic dicarboxylic acid such as oxalic acid, malonic acid, succinic acid, adipic acid, sebacic acid, azelaic acid, n-dodecyl succinic acid, nonane dicarboxylic acid, decane dicarboxylic acid, undecane dicarboxylic acid, dodecane dicarboxylic acid, and tetra decane dicarboxylic acid; an alicyclic dicarboxylic acid such as cyclohexane dicarboxylic acid; an aromatic dicarboxylic acid such as phthalic acid, isophthalic acid, and terephthalic acid; a polyvalent carboxylic acid having a valence of 3 or more such as trimellitic acid, and pyromellitic acid; and an anhydride or alkyl ester having 1 to 3 carbon atoms of these carboxylic acid compounds. These may be used singly alone, or in combination of two or more kinds thereof.

The polyhydric alcohol is a compound containing two or more hydroxy groups in one molecule. Specific examples of the polyhydric alcohol include an aliphatic diol such as 1,2-propanediol, 1,3-propanediol, 1,4-butanediol, 1,5-pentanediol, 1,6-hexanediol, 1,7-heptanediol, 1,8-octanediol, 1,9-nonanediol, dodecanediol, neopentyl glycol, and 1,4-butenediol; and a polyhydric alcohol having a valence of 3 or more such as glycerin, pentaerythritol, trimethylol propane, and sorbitol. These may be used singly alone, or in combination of two or more kinds thereof.

It is preferred that the crystalline polyester resin contains a hybrid polyester resin obtained by bonding to different kinds of resins. In this case, due to the high affinity of the vinyl-based polymerization segment to be introduced into the hybrid polyester resin with an amorphous resin, the hybrid crystalline resin is easily compatible with the amorphous resin. Therefore, when the crystalline polyester resin contains the hybrid polyester resin, the molecular chains of the crystalline resin tend to be easily arranged. As a result, as compared with a non-hybrid crystalline resin, even though the % by mass of the hybrid polyester resin to be introduced is low, it becomes easy to control the volume resistivity at 25° C. with 50% RH to $1.0\times10^{14}$ Ω·cm or more, and the volume resistivity at 67° C. to $1.0\times10^{15}$ Ω·cm or less.

The melting point ($T_m$) of the crystalline polyester resin (hybrid crystalline polyester resin, and non-hybrid crystalline polyester resin described later) is preferably 55 to 90° C., and more preferably 70 to 85° C. When the melting point of the crystalline polyester resin is in the range described above, satisfactory low-temperature fixability and excellent hot offset resistance can be obtained. Note that the melting point of the crystalline polyester can be controlled by the resin composition.

In the present invention, the melting point of the crystalline polyester resin is a value measured as follows. That is, using a differential scanning calorimeter "Diamond DSC" (manufactured by PerkinElmer, Inc.), the melting point is measured by the measurement conditions (temperature rising and cooling conditions) through a first temperature raising process of raising the temperature from 0° C. to 200° C. at a temperature rise/drop rate of 10° C./min, a cooling process of cooling from 200° C. to 0° C. at a cooling rate of 10° C./min, and a second heating process of raising the temperature from 0° C. to 200° C. at a temperature rise/drop rate of 10° C./min in this order, and based on the DSC curve obtained by this measurement, the endothermic peak top temperature derived from the crystalline polyester resin in the first temperature raising process is taken as the melting point ($T_m$). As the measurement procedure, 3.0 mg of a measurement sample (crystalline polyester resin) is sealed in a pan made of aluminum, and the pan is set in a Diamond DSC sample holder. As the reference, an empty pan made of aluminum is used.

In addition, the molecular weight of the crystalline polyester resin as measured by gel permeation chromatography (GPC) is preferably 5000 to 50000 in weight average molecular weight (Mw), and 1500 to 25000 in number average molecular weight (Mn). The molecular weight of the crystalline polyester resin by GPC is measured in the similar manner as in the above except that a crystalline polyester resin is used as the measurement sample.

It is preferred that the crystalline polyester resin contains a crystalline polyester resin formed by chemically bonding a vinyl-based polymerization segment and a polyester polymerization segment (hereinafter, such a crystalline polyester resin having multiple segments is also referred to as a "hybrid crystalline polyester resin" or simply "hybrid resin"). In this case, it is preferred that the vinyl-based polymerization segment and the polyester polymerization segment are crystalline polyester resins bonded via a dual reactive monomer. Note that the above-described polyester polymerization segment refers to a portion derived from a crystalline polyester resin. That is, the polyester polymerization segment refers to a molecular chain having the same chemical structure as that constituting the crystalline polyester resin.

[Vinyl-Based Polymerization Segment]

The vinyl-based polymerization segment constituting the hybrid crystalline resin refers to a portion derived from a vinyl-based resin. That is, the vinyl-based polymerization segment refers to a molecular chain having the same chemical structure as that constituting the vinyl-based resin. Herein, as the vinyl-based monomer, the ones described above as the monomers constituting the vinyl-based resin can be similarly used, therefore, the detailed description is omitted here. Note that there is no particular limitation on the content of the vinyl-based polymerization segment in the hybrid crystalline resin, but the hybridization ratio of the hybrid crystalline resin is preferably 40% by mass or more, more preferably 40 to 60% by mass, and furthermore preferably 45 to 50% by mass.

[Polyester Polymerization Segment]

The polyester polymerization segment constituting the hybrid resin is constituted of a crystalline polyester resin produced by subjecting a polyvalent carboxylic acid and a polyhydric alcohol to a polycondensation reaction in the presence of a catalyst. Herein, specific kinds of the polyvalent carboxylic acid and polyhydric alcohol are as described above.

(Dual Reactive Monomer)

The expression "dual reactive monomer" is referred to as a monomer bonding a polyester polymerization segment to a vinyl-based polymerization segment, and having both of a group selected from a hydroxy group, a carboxy group, an epoxy group, a primary amino group, and a secondary amino group, which form a polyester polymerization segment, and an ethylenically unsaturated group that forms a vinyl-based polymerization segment, in the molecule. Preferably, the dual reactive monomer is preferably a monomer having a hydroxy group or a carboxyl group, and an ethylenically unsaturated group. More preferably, the dual reactive monomer is preferably a monomer having a carboxyl group, and an ethylenically unsaturated group. That is, a vinyl-based carboxylic acid is preferred.

Specific examples of the dual reactive monomer include acrylic acid, methacrylic acid, fumaric acid, and maleic acid, and further, esters of these hydroxyalkyls (having 1 to 3 carbon atoms) may also be mentioned, but acrylic acid, methacrylic acid, or fumaric acid is preferred from the viewpoint of the reactivity. The polyester polymerization segment and the vinyl-based polymerization segment are bonded via the dual reactive monomer.

The use amount of the dual reactive monomer is, from the viewpoint of improving the low temperature fixability, the high temperature offset resistance, and the durability of the toner, preferably 1 to 10 parts by mass, and more preferably 4 to 8 parts by mass based on 100 parts by mass of the total amount of the vinyl-based monomers constituting the vinyl-based polymerization segment.

[Production Method of Hybrid Crystalline Resin]

As the method for producing the hybrid crystalline resin, an existing general scheme can be used. Representative methods include the following three methods.

(1) A method in which a polyester polymerization segment is polymerized in advance, and the polyester polymerization segment is reacted with a dual reactive monomer, and further the resultant preparation is reacted with an aromatic vinyl monomer and a (meth)acrylic acid ester-based monomer for forming a vinyl-based polymerization segment to form a hybrid crystalline resin.

(2) A method in which a vinyl-based polymerization segment is polymerized in advance, and the vinyl-based polymerization segment is reacted with a dual reactive monomer, and further the resultant preparation is reacted with a polyvalent carboxylic acid and a polyhydric alcohol for forming a polyester polymerization segment to form a polyester polymerization segment.

(3) A method in which a polyester polymerization segment and a vinyl-based polymerization segment are polymerized in advance, and these segments are reacted with a dual reactive monomer to bond both segments to each other.

In the present invention, although any of the above-described production methods can be used, among the production methods, preferably, the method of the above-described item (2) is preferred. Specifically, it is preferred that a polyvalent carboxylic acid and a polyhydric alcohol, which form a polyester polymerization segment, a vinyl-based monomer and a dual reactive monomer, which form a vinyl-based polymerization segment, are mixed, and into the resultant mixture, a polymerization initiator is added to perform the addition polymerization of a vinyl-based monomer and a dual reactive monomer to form a vinyl-based polymerization segment, and then an esterification catalyst is added and a polycondensation reaction is performed.

Herein, as the catalyst for synthesizing a polyester polymerization segment, conventionally known various catalysts can be used. Further, examples of the esterification catalyst include a tin compound such as dibutyltin oxide, and tin (II) 2-ethylhexanoate, and a titanium compound such as titanium diisopropylate bistriethanolaminate, and example of the esterification promoter includes gallic acid (3,4,5-trihydroxybenzoic acid).

<Crystalline Substance>

It is preferred that the above-described toner base particles contain a crystalline substance from the viewpoint that the melting becomes faster and the volume resistivity can be suitably lowered when heated.

The crystalline substance according to the present invention is referred to as a substance having a definite endothermic peak but not a stepwise endothermic change in differential scanning calorimetry (DSC) of toner. The definite endothermic peak is as described above in the "[Crystalline polyester resin]".

As such a crystalline substance, a crystalline polyester resin that is the above-described binder resin, and a release agent described later such as wax can be mentioned. In particular, it is preferred that as the crystalline substance, a crystalline polyester resin is contained. In this way, since the conductivity can be improved, the volume resistivity at room temperature can be easily lowered, and further, the crystalline substance becomes easy to melt in a heated state and the volume resistivity becomes lower, and as a result, the volume resistivity can be suitably adjusted. Specifically, it is preferred that a crystalline polyester resin is contained in toner base particles within the range of 1 to 20% by mass because the occurrence of electrostatic offset can be more suppressed and the chargeability can be suitably achieved. If the content is 1% by mass or more, the volume resistivity at 67° C. is not extremely high, and eventually the occurrence of electrostatic offset can be more suppressed. Further, if the content is 20% by mass or less, the volume resistivity at 25° C. with 50% RH does not become excessively low, and the chargeability can be favorably achieved.

<Release Agent>

In the toner according to the present invention, it is preferred that the toner base particles contain a releasing agent from the viewpoint of more appropriately exerting the effect. In the case where the toner base particles are constituted to contain a release agent, from the viewpoint of the surface seepage of a releasing agent at the time of fixing, the release agent is preferably contained particularly in an amorphous resin.

As the release agent, a known release agent can be used, and for example, wax or the like can be mentioned.

As the wax, in particular, a polyolefin-based wax such as a low molecular weight polypropylene or polyethylene, and an oxidation-type polypropylene or polyethylene, or an ester-based wax such as behenyl behenate can be suitably used. Among them, it is preferred that the toner contains an ester-based wax as the release agent. In this case, the ester-based wax has high crystallinity, and for this reason, the volume resistivity can be suitably adjusted, and the effect of the invention of the present application can be more suitably exerted.

Note that the release agent may be added in the aggregation step of the binder resin as a dispersion liquid, however, from the viewpoint of the dispersibility of the releasing agent inside the toner base particles, it is preferred that the release agent is added in the step of polymerizing an amorphous resin.

Further specific examples of the wax include a polyolefin wax such as polyethylene wax, and polypropylene wax; a branched chain hydrocarbon wax such as microcrystalline wax; a long chain hydrocarbon-based wax such as paraffin wax, and sasol wax; a dialkyl ketone-based wax such as distearyl ketone; an ester-based wax such as carnauba wax, montan wax, behenyl behenate, trimethylolpropane tribehenate, pentaerythritol tetrabehenate, pentaerythritol diacetate dibehenate, glycerin tribehenate, 1,18-octadecanediol distearate, tristearyl trimeritate, and distearyl maleate; and an amide-based wax such as ethylenediamine behenylamide, and trimellitic acid tristearylamide.

Among them, from the viewpoint of the releasability at the time of low-temperature fixing, it is preferred to use one having a low melting point, specifically, one having a melting point within the range of 40 to 90° C. The content ratio of the release agent in the toner base particles is preferably 1 to 20% by mass, and more preferably within the range of 5 to 20% by mass.

<Coloring Agent>

As the coloring agent, it is not particularly limited in color and material, and a known coloring agent such as a coloring agent used for general toner can be suitably used.

For example, examples of the carbon black include a channel black, a furnace black, an acetylene black, a thermal black, and a lamp black, and examples of the black iron oxide include magnetite, hematite, and iron titanium trioxide.

Examples of the dye include C.I. Solvent Red 1, C.I. Solvent Red 49, C.I. Solvent Red 52, C.I. Solvent Red 58, C.I. Solvent Red 63, C.I. Solvent Red 111, C.I. Solvent Red 122, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 60, C.I. Solvent Blue 70, C.I. Solvent Blue 93, and C.I. Solvent Blue 95.

Examples of the pigment include C.I. Pigment Red 5, C.I. Pigment Red 48:1, C.I. Pigment Red 48:3, C.I. Pigment Red 53:1, C.I. Pigment Red 57:1, C.I. Pigment Red 81:4, C.I. Pigment Red 122, C.I. Pigment Red 139, C.I. Pigment Red 144, C.I. Pigment Red 149, C.I. Pigment Red 150, C.I. Pigment Red 166, C.I. Pigment Red 177, C.I. Pigment Red 178, C.I. Pigment Red 222, C.I. Pigment Red 238, C.I. Pigment Red 269, C.I. Pigment orange 31, C.I. Pigment orange 43, C.I. Pigment Yellow 14, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 156, C.I. Pigment Yellow 158, C.I. Pigment Yellow 180, C.I. Pigment Yellow 185, C.I. Pigment green 7, C.I. Pigment Blue 15:3, and C.I. Pigment Blue 60.

For each color, as to the coloring agent for obtaining each color toner, those described above can be used singly alone, or in combination of two or more kinds thereof. The content ratio of the coloring agent in the toner base particles is preferably 1 to 10% by mass, and more preferably within the range of 2 to 8% by mass.

<Charge Control Agent>

As the charge control agent, a known compound such as a nigrosine-based dye, a metal salt of naphthenic acid or a higher fatty acid, an alkoxylated amine, a quarternary ammonium salt, an azo-based metal complex, and a salicylic acid metal salt can be used.

The content ratio of the charge control agent is usually 0.1 to 10 parts by mass, and preferably within the range of 0.5 to 5 parts by mass based on 100 parts by mass of the binder resin to be finally obtained.

(External Additive Particles)

The toner according to the present invention may contain external additive particles in addition to the toner base particles. As the external additive particles, conventionally known external additive particles can be used. Examples of the external additive particles include inorganic oxide fine particles including silica fine particles, alumina fine particles, and titania fine particles, inorganic stearic acid compound fine particles such as aluminum stearate fine particles, and zinc stearate fine particles, and inorganic titanic acid compound fine particles of strontium titanate, zinc titanate, or the like. These can be used singly alone, or in combination of two or more kinds thereof. These inorganic fine particles are preferably subjected to a gloss treatment by a silane coupling agent, a titanium coupling agent, a higher fatty acid, a silicone oil, or the like in order to improve the heat-resistant storability and the environmental stability.

Further, as the organic fine particles, particles obtained by the radical polymerization of a radically polymerizable monomer containing a crosslinkable vinyl monomer may be used.

(Glass Transition Point of Toner)

The glass transition point ($T_g$) of the toner according to the present invention is preferably within the range of 25 to 65° C., and more preferably within the range of 35 to 55° C. When the glass transition point of the toner according to the present invention is within the above-described range, both of satisfactory low-temperature fixability and heat-resistant storability can be achieved. The glass transition point of the toner is measured in the similar manner as in the amorphous resin except that a toner is used as the measurement sample.

(Particle Diameter of Toner)

The average particle diameter of the toner according to the present invention is, for example, preferably 3 to 8 μm in volume median diameter, and more preferably within the range of 5 to 8 μm. The average particle diameter can be controlled by the concentration of the flocculant to be used, the addition amount of the organic solvent to be used, the fusion time, the composition of the binder resin to be used, and the like, during production. When the volume median diameter is in the above-described range, an extremely fine dot image at a level of 1,200 dpi can be faithfully reproduced. The volume median diameter of the toner is measured and calculated using a measurement device connected to a computer system in which software for data processing "Software V 3.51" is mounted on "Multisizer 3" (manufactured by Beckman Coulter, Inc.).

Specifically, 0.02 g of a measurement sample (toner) is added to 20 mL of a surfactant solution (for example, a surfactant solution prepared by diluting a neutral detergent containing a surfactant component 10 times with pure water for the purpose of dispersing the toner particles) and allowed to be blended, and then the resultant mixture is subjected to ultrasonic dispersion for 1 minute to prepare a toner dispersion liquid, and the toner dispersion liquid is injected with a pipette into a beaker containing "ISOTON II" (manufactured by Beckman Coulter, Inc.) in the sample stand until the displayed concentration of the measurement device reaches 8%. Herein, by setting the concentration in this concentration range, a reproducible measurement value can be obtained. Subsequently, in the measurement device, the measurement particle count number is set to 25000, the aperture diameter is set to 100 μm, the range of 2 to 60 μm, which is the measurement range, is divided into 256 to calculate the frequency value, and the particle diameter corresponding to 50% from the larger volume-integrated fraction is taken as the volume median diameter.

(Average Circularity of Toner)

In the toner according to the present invention, from the viewpoints of the stability of charging characteristics and the low-temperature fixability of each toner particle constituting this toner, the average circularity is preferably 0.930 to 1.000, and more preferably within the range of 0.950 to 0.995. When the average circularity is in the above range, each toner particle is hardly crushed, contamination of the triboelectric charging member is suppressed, the toner chargeability is stabilized, and the image quality becomes high in the image to be formed. The average circularity of toner is a value measured using "FPIA-2100" (manufactured by Sysmex Corporation). Specifically, the measurement sample (toner) is wetted with an aqueous solution containing a surfactant, the wetted toner is subjected to ultrasonic dispersion treatment for 1 minute to disperse the toner, and then the dispersion of toner particles is photographed with "FPIA-2100" (manufactured by Sysmex Corporation) under the measurement conditions of an HPF (high power focusing) mode at an appropriate concentration of the HPF detection number of 3,000 to 10,000. The circularity of each toner particle is calculated in accordance with the following equation, the values of circularity of the toner particles are summed and the summed value is divided by the number of total toner particles to obtain the average circularity of toner. When the HPF detection number is in the above-described range, the reproducibility is obtained.

Circularity=(circumference length of a circle having an area equivalent to the projection area of a particle image)/(circumference length of a projection image of a particle)

<Production Method of Toner>

(Production Method of Toner Base Particles)

The toner base particles according to the present invention can be produced by, for example, an emulsion aggregation method. The production method in the case of producing the toner base particles according to the present invention by an emulsion aggregation method includes, for example, a step of preparing a mixed dispersion liquid by adding a dispersion liquid (a) containing amorphous resin fine particles and a dispersion liquid (b) containing crystalline polyester resin fine particles to an aqueous medium, and a step of forming toner base particles by raising the temperature of the mixed dispersion liquid and aggregating the amorphous resin fine particles and the crystalline polyester resin fine particles to form toner base particles.

Herein, the expression "aqueous medium" is referred to as a medium containing at least 50% by mass or more of water, and as a component other than the water, an organic solvent soluble in water can be mentioned. Examples of the aqueous medium include methanol, ethanol, isopropanol, butanol, acetone, methyl ethyl ketone, dimethylformamide, methyl cellosolve, and tetrahydrofuran. Among them, it is preferred to use an alcohol-based organic solvent such as methanol, ethanol, isopropanol, and butanol, which are organic solvents that do not dissolve a resin. Preferably, only water is used as the aqueous medium.

the above-described production method can be constituted to include, for example, the following steps. Herein, the following examples describe the case where the amorphous resin fine particles contain a releasing agent, crystalline polyester resin fine particles are contained, and further the toner base particles contain a coloring agent, the technical scope of the present invention is not limited to these embodiments.

(1) A step of preparing a dispersion liquid (a), in which a dispersion liquid (a) including amorphous resin fine particles that contains a releasing agent is prepared, (2) A step of preparing a dispersion liquid (b), in which a crystalline polyester resin is dissolved in an organic solvent, and the crystalline polyester resin dissolved in the organic solvent is emulsified and dispersed in an aqueous dispersion medium, and then the organic solvent is removed to prepare a dispersion liquid (b) containing crystalline polyester resin fine particles, (3) A step of preparing a mixed dispersion liquid, in which the dispersion liquid (a) prepared in the above (1) and the dispersion liquid (b) prepared in the above (2) are added to an aqueous medium to prepare a mixed dispersion liquid, (4) A step of forming aggregate particles, in which the temperature of the mixed dispersion liquid prepared in the above (3) is raised, and the amorphous resin fine particles and the crystalline polyester resin fine particles are aggregated to form toner base particles, (5) An aging step, in which the aggregated particles formed in the above (4) are aged by heat energy to control the shape, and toner base particles are obtained, (6) A cooling step, in which the dispersion liquid of toner base particles is cooled, (7) A filtering and washing step, in which the toner base particles are separated from the aqueous medium by filtration, and the surfactant and the like are removed from the toner base particles, and (8) A drying step, in which the washed toner base particles are dried.

When performing each of the steps described above, conventionally known knowledge can be appropriately referred to. For example, as to the above-described dispersion liquid (a) containing amorphous resin fine particles and dispersion liquid (b) containing crystalline polyester resin fine particles, these dispersion liquids can be prepared by using various emulsification methods such as a method in which emulsification is performed by mechanical shearing force, and are preferably prepared by using a technique called a phase inversion emulsification method. In particular, as to the dispersion liquid (b), when the one prepared by a phase inversion emulsification method is used, oil droplets can be uniformly dispersed by changing the stability of the carboxyl group of polyester, and this is excellent in that the dispersion is not forcibly performed by shearing force as in a mechanical emulsification method.

In the "phase inversion emulsification method", by passing through a dissolution step in which a resin is dissolved in an organic solvent to obtain a resin solution, a neutralization step in which a neutralizing agent is charged in the resin solution, an emulsification step in which the resin solution after the neutralization is emulsified and dispersed in an aqueous dispersion medium to obtain a resin emulsion, and a desolvation step in which the organic solvent is removed from the resin emulsion, a dispersion liquid of resin fine particles is obtained. Note that the particle diameter of the resin fine particles in the dispersion liquid can be controlled by changing the addition amount of the neutralizing agent.

Further, by using the above-described toner base particles as cores, and providing a shell layer on each of the surfaces of cores, toner base particles having a core-shell structure can be obtained. By adopting the core-shell structure, the heat-resistant storability and the low temperature fixability can be further improved. In order to produce toner base particles having a core-shell structure, for example, in the above-described production method, After the step of forming aggregate particles of the above (4), the following (4') A step in which by using the toner base particles prepared in the above (4) as core particles, a dispersion liquid for shell (c) containing amorphous resin fine particles is added to the mixed dispersion liquid to form a shell on each of the surfaces of the core particles is performed, and then the subsequent steps after the above (5) is performed.

Furthermore, the amorphous resin fine particles in the above (1) may have a multilayer structure of two or more layers which have a different composition from each other. The dispersion liquid of the amorphous resin fine particles having a multilayer structure can be obtained by a polymerization reaction with multiple stages. For example, the dispersion liquid of the amorphous resin fine particles having a 2-layer structure can be obtained, for example, by polymerizing vinyl monomers (first stage polymerization) to prepare a dispersion liquid of amorphous resin fine particles, and then by adding a polymerization initiator and a vinyl monomer to the dispersion liquid to perform the polymerization (second stage polymerization).

Note that the method for adjusting the volume resistivity according to the present invention can be performed by the following three points.

In the step of forming aggregate particles, the addition amount of the crystalline polyester resin is adjusted.

In the step of forming aggregate particles, the residual activator ratio is adjusted by adjusting the pH in the washing step with the use of an activator containing elemental sulfur (S) (in the washing step, when the pH is on the alkaline side, the activator is washed, and when the pH is on the acidic side, the activator easily remains.)

In the second stage polymerization, an ester wax is added.

<Production Method of Toner Particles>

(External Additive Addition Step)

The external additive addition step is a step of preparing toner particles by adding and mixing external additive particles to the dry-treated toner base particles. As the method for adding the external additive, a dry method in which an external additive is added as powder to the dried toner base particles can be mentioned, and as the mixing device, a mechanical mixing device such as a Henschel Mixer, and a coffee mill can be mentioned.

<Developer for Electrostatic Charge Image Development>

The toner according to the present invention can also be used as a magnetic or non-magnetic one-component developer, however, the toner may be mixed with a carrier and used as a two-component developer. In the case where the toner is used as a two-component developer, as the carrier, magnetic particles made of a conventionally known material, for example, a metal such as iron, ferrite, and magnetite, and an alloy of these metals and a metal such as aluminum and lead can be used. In particular, ferrite particles are preferred. Further, as the carrier, a coated carrier obtained by coating the surfaces of magnetic particles with a coating agent such as a resin, a dispersion-type carrier obtained by dispersing magnetic fine powder in a binder resin, or the like may be used.

The volume median diameter of the carrier is preferably 20 to 100 μm, and more preferably 25 to 80 μm. The volume median diameter of the carrier can be measured typically by a laser diffraction particle size analyzer "HELOS" (manufactured by Sympatec GmbH) equipped with a wet-type disperser.

Note that the embodiment in which the present invention can be applied is not limited to the embodiments described above, and appropriate changes may be made in a range where the gist of the present invention is not impaired.

For example, a toner having a volume resistivity of $1.0\times10^{14}$ Ω·cm or more at 25° C. with 50% RH by a temperature change method, and further, having a volume resistivity of $1.0\times10^{15}$ Ω·cm or less at 67° C. by the temperature change method can be produced. Further, even a resin other than those described above can be contained as a binder resin as long as the resin does not inhibit the effect of the present invention. As an external additive, organic fine particles can also be used as additives.

EXAMPLES

Hereinafter, the present invention will be described specifically with reference to Examples, however, the present invention is not limited to the following Examples. Note that the expression of "parts" or "%" is used in Examples, and the "parts" or "%" represents "% by mass" unless otherwise specifically noted.

[Preparation of Toners 1 to 11]

The following dispersion liquids (1) and (2) of crystalline polyester resin (CPEs) fine particles, a dispersion liquid (1) of amorphous polyester resin fine particles, a dispersion liquid (1) of wax-containing styrene-acrylic resin fine particles, and a dispersion liquid of a release agent, and a dispersion liquid (Cy1) of colorant fine particles were prepared as follows, and used for preparation of Toners 1 to 11.

(Preparation of Dispersion Liquid (1) of Crystalline Polyester Resin Fine Particles)

Into a 5-L volume reaction vessel equipped with a stirring device, a temperature sensor, a cooling pipe, and a nitrogen introduction device, 281 parts by mass of tetradecanedioic acid and 206 parts by mass of 1,6-hexanediol were charged, and while stirring this system, the internal temperature was raised to 190° C. over 1 hour. After confirming that the state was a uniformly stirred state, $Ti(OBu)_4$ as a catalyst was charged in an amount of 0.003% by mass based on 100% by mass of the charged amount of tetradecanedioic acid. After that, the internal temperature was raised from 190° C. to 240° C. over 6 hours while distilling off the generated water. After that, polymerization was performed by continuing the dehydration condensation reaction over 6 hours under the condition of a temperature of 240° C. to obtain a crystalline polyester resin (1). The number average molecular weight (Mn) was 4400.

30 parts by mass of the above-described crystalline polyester resin (1) was transferred with a molten state to an emulsifying and dispersing machine "Cavitron CD 1010" (manufactured by Eurotec, Ltd.) at a transfer rate of 100 parts by mass per minute. Further, at the same time as the transfer of the crystalline polyester resin (1) in a molten state, dilute ammonia water having a concentration of 0.37% by mass, which is obtained by diluting 70 parts by mass of reagent ammonia water with ion exchanged water in an aqueous solvent tank was transferred to the emulsifying and dispersing machine at a transfer rate of 0.1 L per minute while heating to 100° C. with a heat exchanger. Subsequently, by operating this emulsifying and dispersing machine under the conditions of a rotor rotational speed of 60 Hz and a pressure of 5 kg/cm$^2$, a dispersion liquid (1) of crystalline polyester resin fine particles having a volume median diameter of 300 nm and a solid content of 25% by mass was prepared.

(Preparation of Dispersion Liquid (1) of Wax-Containing Styrene-Acrylic Resin Fine Particles)

[First Stage Polymerization]

Into a reaction vessel equipped with a stirring device, a temperature sensor, a temperature control device, a cooling pipe, and a nitrogen introduction device, an anionic surfactant solution in which 2.0 parts by mass of an anionic surfactant "sodium lauryl sulfate" was dissolved in 2900 parts by mass of ion exchanged water in advance was charged, the internal temperature was raised to 80° C. while stirring the anionic surfactant solution at a stirring speed of 230 rpm under a nitrogen stream. Into this surfactant solution, 9.0 parts by mass of a polymerization initiator "potassium persulfate: KPS" was added, the internal temperature was set to 78° C., and then a solution (1) including styrene: 540 parts by mass,
n-butyl acrylate: 270 parts by mass,
methacrylic acid: 65 parts by mass, and
n-octyl mercaptan: 17 parts by mass was added dropwise over 3 hours. After the completion of the dropwise addition, the polymerization (first stage polymerization) was performed by heating and stirring at 78° C. over 1 hour to prepare a "dispersion liquid of resin particles [a1].

[Second Stage Polymerization: Formation of Intermediate Layer]

In a flask equipped with a stirring device, into a solution (2) including styrene: 94 parts by mass, n-butyl acrylate: 60 parts by mass, methacrylic acid: 11 parts by mass, and n-octyl mercaptan: 5 parts by mass, 51 parts by mass of ester wax (WEP-3 having a melting point of 76° C. manufactured by NOF CORPORATION) as a release agent was added, the resultant mixture was heated to 85° C. for dissolution to prepare a "monomer solution [2]".

Herein, a surfactant solution in which 2 parts by mass of an anionic surfactant "sodium lauryl sulfate" was dissolved in 1100 parts by mass of ion exchanged water was heated to 90° C. Into this surfactant solution, a "dispersion liquid of resin particles [a1]" was added so that the resin particles [a1] are 28 parts by mass in terms of solid content, and then the monomer solution [2] was mixed and dispersed for 4 hours with a mechanical dispersing machine having a circulation pass "CLEARMIX" (manufactured by M Technique Co., Ltd.) to prepare a dispersion liquid containing emulsified particles having a dispersed particle diameter of 350 nm.

Into the dispersion liquid, an initiator aqueous solution in which 2.5 parts by mass of a polymerization initiator "KPS" was dissolved in 110 parts by mass of ion exchanged water was added, and by heating and stirring this system at 90° C. over 2 hours, the polymerization (second stage polymerization) was performed to prepare a "dispersion liquid of resin particles [a2]".

[Third Stage Polymerization: Formation of Outer Layer]

Into the above-described "dispersion liquid of resin particles [a2]", an initiator aqueous solution in which 2.5 parts by mass of a polymerization initiator "KPS" was dissolved in 110 parts by mass of ion exchanged water was added, and under a temperature condition of 80° C., a solution (3) including styrene: 230 parts by mass, n-butyl acrylate: 100 parts by mass, and n-octyl mercaptan: 5.2 parts by mass was added dropwise over 1 hour. After the completion of the dropwise addition, the polymerization (third stage polymerization) was performed by heating and stirring over 3 hours. After that, the resultant preparation was cooled down to 28° C. to prepare a "dispersion liquid (1) of wax-containing styrene-acrylic resin fine particles" in which wax-containing styrene-acrylic resin fine particles were dispersed in an anionic surfactant solution. The wax content is 9.8% based on 100 parts by mass of the wax-containing styrene-acrylic resin.

(Preparation of Dispersion Liquid (2) of Wax-Containing Styrene-Acrylic Resin Fine Particles)

The dispersion liquid (2) of wax-containing styrene-acrylic resin fine particles was prepared in the similar manner as in the preparation of the dispersion liquid (1) of wax-containing styrene-acrylic resin fine particles except that paraffin wax (HNP-0190 having a melting point of 76° C. manufactured by NIPPON SEIRO CO., LTD.) was used instead of the ester wax in the second stage polymerization.

(Preparation of Dispersion Liquid (Cy1) of Colorant Fine Particles)

90 parts by mass of sodium lauryl sulfate was added into 1600 parts by mass of ion exchanged water. While stirring this solution, 420 parts by mass of copper phthalocyanine (C.I. Pigment Blue 15:3) was gradually added into the solution, subsequently, the resultant mixture solution was subjected to dispersion treatment by using a stirring device "CLEARMIX" (manufactured by M Technique Co., Ltd.) to prepare a dispersion liquid (Cy1) of colorant fine particles. The volume median diameter of the colorant fine particles contained in the above-described dispersion liquid (Cy1) was 130 nm.

(Preparation of Dispersion Liquid (1) of Amorphous Polyester Resin (APEs) Fine Particles)

In a reaction vessel equipped with a cooling pipe, a stirrer, and a nitrogen introduction pipe, 316 parts by mass of an adduct of bisphenol A with 2 moles of propylene oxide, 80 parts by mass of terephthalic acid, 34 parts by mass of fumaric acid, and 2 parts by mass of titanium tetraisopropoxide as a polycondensation catalyst were divided into 10 portions and placed, and the resultant mixture was allowed to react at 200° C. for 10 hours while distilling off the generated water under a nitrogen stream.

Next, the reaction was conducted under reduced pressure of 13.3 kPa (100 mmHg), and the product was taken out at the time point when the softening point reached 104° C. to obtain an amorphous polyester resin (1).

100 parts by mass of the amorphous polyester resin (1) obtained above was pulverized with "Roundel Mill Type: RM-1N type" (manufactured by TOKUJU CORPORATION), the pulverized material was mixed with 638 parts by mass of a sodium lauryl sulfate solution having a concentration of 0.26% by mass, which was prepared in advance, and the resultant mixture was subjected to ultrasonic dispersion with V-LEVEL, and 300 μA for 60 minutes using an ultrasonic homogenizer "US-150T" (manufactured by NIHONSEIKI KAISHA LTD.) while being stirred, to prepare a "dispersion liquid (1) of amorphous polyester resin fine particles" in which an amorphous polyester resin (1) having a volume median diameter (D50) of 150 nm was dispersed.

(Preparation of Dispersion Liquid of Release Agent)

59.5 parts by mass of ester wax (WEP3 having a melting point of 73° C. manufactured by NOF CORPORATION), 5 parts by mass of sodium lauryl sulfate being an anionic surfactant, and 200 parts by mass of ion exchanged water were heated to 110° C., and dispersed by using a homogenizer (ULTRA-TURRAX T50 manufactured by IKA), and then the resultant preparation was subjected to dispersion treatment with a Manton Gaulin high pressure homogenizer (manufactured by Gaulin Inc.) to prepare a dispersion liquid of a release agent in which a release agent having a volume average particle diameter of 190 nm was dispersed (release agent concentration: 22.5% by mass).

<Preparation of Toner 1>

Into a reaction vessel equipped with a stirring device, a temperature sensor, and a cooling pipe, 170 parts by mass (in terms of solid content) of a dispersion liquid (1) of wax-containing styrene-acrylic resin fine particles, and 2000 parts by mass of ion exchanged water were charged, and then into the resultant mixture, a 5 mol/L sodium hydroxide aqueous solution was added to adjust the pH of the solution to 10 (at the liquid temperature of 25° C.).

After that, 10 parts by mass (in terms of solid content) of a dispersion liquid (Cy1) of colorant fine particles was charged in the reaction vessel, subsequently an aqueous solution prepared by dissolving 60 parts by mass of magnesium chloride in 60 parts by mass of ion exchanged water was added to the resultant mixture at 30° C. over 10 minutes under stirring. Next, the mixture was left to stand for 3 minutes, 20 parts by mass (in terms of solid content) of a dispersion liquid (1) of crystalline polyester resin fine particles was added to the mixture over 10 minutes, and then the temperature was raised to 82° C. over 60 minutes, and the particle growth reaction was continued while maintaining 82° C.

In this state, the particle diameter of associated particles was measured with "Coulter Multisizer 3" (manufactured by Beckman Coulter, Inc.), an aqueous solution prepared by dissolving 190 parts by mass of sodium chloride in 760 parts by mass of ion exchanged water was added to the mixture at the time point when the volume median diameter reached 6.0 μm to stop the particle growth, and by heating and stirring in a state of 74° C., fusion of the particles was allowed to proceed. The temperature was cooled to 30° C. at a cooling rate of 2.5° C./min at the time point when the average circularity reached 0.961 by using a device for measuring the average circularity of particles "FPIA-2100" (manufactured by Sysmex Corporation, the HPF detection number was set to 4000).

Next, solid and liquid separation was performed, the dehydrated toner cake was redispersed in ion exchanged water, the pH was adjusted to 3 (at the liquid temperature of 20° C.) using diluted hydrochloric acid, and solid-liquid separation was performed. After that, the obtained toner cake was redispersed in ion exchanged water, then solid-liquid separation was performed once (that is, the washing step was performed twice in total), and the resultant preparation was dried at 40° C. for 24 hours to obtain toner base particles (1).

To 100 parts by mass of the obtained toner base particles (1), 0.6 parts by mass of hydrophobic silica (the number average primary particle diameter=12 nm, and the hydrophobicity=68) and 1.0 part by mass of hydrophobic titanium oxide (the number average primary particle diameter=20 nm, and the hydrophobicity=63) were added, and the resultant mixture was mixed at 32° C. for 20 minutes at a rotor blade peripheral speed of 35 mm/sec with a "Henschel Mixer" (manufactured by NIPPON COKE & ENGINEERING CO., LTD.), and then the mixture was subjected to external additive treatment for removing coarse particles using a sieve having a mesh opening of 45 μm to prepare Toner 1.

<Preparation of Toner 2>

Toner 2 was prepared in the similar manner as in the preparation of Toner 1 except that the addition amount of a dispersion liquid (1) of wax-containing styrene-acrylic resin fine particles was set to 150 parts by mass (in terms of solid content), and the addition amount of a dispersion liquid (1) of crystalline polyester resin fine particles was set to 40 parts by mass (in terms of solid content).

<Preparation of Toner 3>

Toner 3 was prepared in the similar manner as in the preparation of Toner 1 except that the addition amount of a dispersion liquid (1) of wax-containing styrene-acrylic resin fine particles was set to 188 parts by mass (in terms of solid content), and the addition amount of a dispersion liquid (1) of crystalline polyester resin fine particles was set to 2 parts by mass (in terms of solid content).

<Preparation of Toner 4>

Toner 4 was prepared in the similar manner as in the preparation of Toner 1 except that the number of times of the washing after adjusting to pH 3 (at the liquid temperature of 20° C.) was set to 3 in the washing step (that is, the "redisperse in ion exchanged water and perform solid-liquid separation" was repeated 3 times.)

<Preparation of Toner 5>

Preparation of Toner 5 was performed in the similar manner as in the preparation of Toner 1, to the extent that in the washing step, the pH was adjusted to 3 (at the liquid temperature of 20° C.), and the solid-liquid separation was performed. After that, Toner 5 was prepared in the similar manner as in the preparation of Toner 1 except that the drying was performed at 40° C. for 24 hours without performing the "solid-liquid separation after the redispersion in ion exchanged water".

<Preparation of Toner 6>

In the preparation of Toner 1, the pH was adjusted to 2 (at the liquid temperature of 20° C.), and the solid and liquid separation was performed in the washing step. After that, the solid-liquid separation was performed twice after the redispersion in ion exchanged water. Toner 6 was prepared by performing the others in the similar manner as in the preparation of Toner 1.

<Preparation of Toner 7>

Toner 7 was prepared in the similar manner as in the preparation of Toner 1 except that the addition amount of a dispersion liquid (1) of wax-containing styrene-acrylic resin fine particles was set to 190 parts by mass (in terms of solid content), and the addition amount of a dispersion liquid (1) of crystalline polyester resin fine particles was set to 0 parts by mass (in terms of solid content).

<Preparation of Toner 8>

Toner 8 was prepared in the similar manner as in the preparation of Toner 1 except that the dispersion liquid (1) of wax-containing styrene-acrylic resin fine particles was changed to a dispersion liquid (2) of wax-containing styrene-acrylic resin fine particles.

<Preparation of Toner 9>

Toner 9 was prepared as follows.

(Emulsion Aggregation Step)

Into a reaction vessel equipped with a stirring device, a temperature sensor, and a cooling pipe, 153.3 parts by mass (in terms of solid content) of a dispersion liquid (1) of amorphous polyester resin (APEs) fine particles, 16.7 parts by mass (in terms of solid content) of a dispersion liquid of a release agent, and 2000 parts by mass of ion exchanged water were charged, and then into the resultant mixture, a 5 mol/L sodium hydroxide aqueous solution was added to adjust the pH of the mixture solution to 10 (at the liquid temperature of 25° C.).

After that, 10 parts by mass (in terms of solid content) of a dispersion liquid (Cy1) of colorant fine particles was charged in the reaction vessel, subsequently, an aqueous solution prepared by dissolving 60 parts by mass of magnesium chloride in 60 parts by mass of ion exchanged water was added to the resultant mixture at 30° C. over 10 minutes under stirring. Next, the mixture was left to stand for 3 minutes, 20 parts by mass (in terms of solid content) of a dispersion liquid (1) of crystalline polyester resin fine particles was added to the mixture over 10 minutes, and then the temperature was raised to 82° C. over 60 minutes, and the particle growth reaction was continued while maintaining 82° C.

In this state, the particle diameter of associated particles was measured with "Coulter Multisizer 3" (manufactured by Beckman Coulter, Inc.), at the time point when the volume median diameter reached 6.0 μm an aqueous solution prepared by dissolving 190 parts by mass of sodium chloride in 760 parts by mass of ion exchanged water was added to the mixture to stop the particle growth, and by heating and stirring in a state of 74° C., fusion of the particles was allowed to proceed. The temperature was cooled to 30° C. at a cooling rate of 2.5° C./min at the time point when the average circularity reached 0.961 by using a device for measuring the average circularity of toner "FPIA-2100" (manufactured by Sysmex Corporation, the HPF detection number was set to 4000).

Next, solid and liquid separation was performed, the dehydrated toner cake was redispersed in ion exchanged water, the pH was adjusted to 3 (at the liquid temperature of 20° C.) using diluted hydrochloric acid, and solid-liquid separation was performed. After that, the toner cake was redispersed in ion exchanged water, then solid-liquid separation was performed once, and the resultant preparation was dried at 40° C. for 24 hours to obtain toner base particles (2).

To 100 parts by mass of the obtained toner base particles (2), 0.6 parts by mass of hydrophobic silica (the number average primary particle diameter=12 nm, and the hydrophobicity=68) and 1.0 part by mass of hydrophobic titanium oxide (the number average primary particle diameter=20 nm, and the hydrophobicity=63) were added, and the resultant mixture was mixed at 32° C. for 20 minutes at a rotor blade peripheral speed of 35 mm/sec with a "Henschel Mixer" (manufactured by NIPPON COKE & ENGINEERING CO., LTD.), and then the mixture was subjected to external additive treatment for removing coarse particles using a sieve having a mesh opening of 45 μm to prepare Toner 9.

<Preparation of Toner 10>

Toner 10 was prepared in the similar manner as in the preparation of Toner 1 except that the number of times of the washing after adjusting to pH 3 (at the liquid temperature of 30° C.) was set to 4 in the washing step (that is, the "redisperse in ion exchanged water and perform solid-liquid separation" was repeated 4 times.)

<Preparation of Toner 11>

Toner 11 was prepared in the similar manner as in the preparation of Toner 1 except that the addition amount of a dispersion liquid (1) of wax-containing styrene-acrylic resin fine particles was set to 148 parts by mass (in terms of solid content), and the addition amount of a dispersion liquid (1) of crystalline polyester resin fine particles was set to 42 parts by mass (in terms of solid content).

As to Toners 1 to 11 prepared as described above, the composition, the mixing amount, and the like were shown in Table I. Note that in Table I, the proportion of the crystalline polyester resin in the toner base particles was defined as the addition amount of the crystalline polyester resin fine particles.

TABLE I

| | Amorphous resin particle dispersion liquid | | | Coloring agent amount | CPEs | | | | |
|---|---|---|---|---|---|---|---|---|---|
| Toner number | Resin type | [parts by mass] (In terms of solid content) | Wax type | [parts by mass] (In terms of solid content) | [parts by mass] (In terms of solid content) | Proportion in binder resin [% by mass] | Washing step Number of times | Washing step pH | Content of element S [at %] |
| 1 | St-Ac | 170.0 | Ester | 10 | 20 | 10.0 | 2 | 3 | 0.51 |
| 2 | St-Ac | 150.0 | Ester | 10 | 40 | 20.0 | 2 | 3 | 0.51 |
| 3 | St-Ac | 188.0 | Ester | 10 | 2 | 1.0 | 2 | 3 | 0.51 |
| 4 | St-Ac | 170.0 | Ester | 10 | 20 | 10.0 | 4 | 3 | 0.20 |
| 5 | St-Ac | 170.0 | Ester | 10 | 20 | 10.0 | 1 | 3 | 0.70 |
| 6 | St-Ac | 170.0 | Ester | 10 | 20 | 10.0 | 3 | 2 | 0.19 |
| 7 | St-Ac | 190.0 | Ester | 10 | 0 | 0.0 | 2 | 3 | 0.51 |
| 8 | St-Ac | 170.0 | Paraffin | 10 | 20 | 10.0 | 2 | 3 | 0.51 |
| 9 | APEs | 1533 | Ester | 10 | 20 | 10.0 | 2 | 3 | 0.51 |
| 10 | St-Ac | 170.0 | Ester | 10 | 20 | 10.0 | 5 | 3 | 0.15 |
| 11 | St-Ac | 148.0 | Ester | 10 | 42 | 21.0 | 2 | 3 | 0.51 |

<Measurement Method of Sulfur Element (S) in X-Ray Analysis (ESCA)>

2 g of toner was molded by applying a load of 9.807 MPa (100 kgf/cm$^2$) over 10 seconds, and a disk-shaped one having a thickness of around 2 mm and 40ϕ was conditioned overnight at 20° C. with 50% RH, and was taken as the measurement sample.

After that, using an X-ray photoelectron spectrometer ESCA-1000 (manufactured by Shimadzu Corporation), the area ratio of the elements being present on the surface was measured. Note that the results were described in the content of element S in Table I.

Measurement Conditions

X-ray intensity: 30 mA, 10 kV

Analysis depth: normal mode

Quantified element: sulfur element (S)

[Physical Properties of Toner (Measurement of Volume Resistivity in Temperature Change Method)]

2 g of toner was molded by applying a load of 9.807 MPa (100 kgf/cm$^2$) over 10 seconds, and a disk-shaped one having a thickness of around 2 mm and 40ϕ was conditioned overnight at 20° C. with 50% RH, and was taken as the measurement sample.

Measurement was performed by a high resistance measurement device 5451 (manufactured by ADC CORPORATION) with an electrode set inside a small-sized thermostatic chamber (SH-222 manufactured by ESPEC CORP.) that was installed in a room at 25° C. with 50% RH. As to the measurement conditions, the main electrode diameter was 11 mm, 1000 V was applied, the discharge time was 1 minute, the charge time was 1 second, the measurement interval was 10 seconds, and the sample thickness was measured with a digital manometer, and the obtained value was input. A temperature program was set up for the small-sized thermostatic chamber so as to be set at 25° C. for 1 minute and then at 100° C. (at a temperature rise rate of 5 to 6° C./min). Measurement with a high resistance measurement device was started at the same time as the start of the temperature program, the behavior of the volume resistivity of the measurement sample for the temperature from 25° C. to 100° C. (with the humidity of 50% RH at any temperature) was obtained, and the volume resistivity of the toner at 25° C. with 50% RH and at 67° C. was determined.

[Evaluation]

With respect to Toners 1 to 11, the charge amount and the sticking force were measured as in the following manner. The results are shown in Table II.

Note that in each evaluation, developers 1 to 11 were prepared for Toners 1 to 11, and the developers 1 to 11 were used to evaluate the toners, respectively.

<Preparation of Developers 1 to 11>

100 parts by mass of ferrite core, and 5 parts by mass of copolymer resin particles of cyclohexyl methacrylate/methyl methacrylate (at a copolymerization ratio of 5/5) were charged into a high speed mixer with stirring blades, and stirred and mixed at 120° C. for 30 minutes to form a resin coat layer on the surface of the ferrite core by the action of mechanical impact force, and a carrier having a volume median diameter of 35 μm was obtained.

The volume median diameter of the carrier was measured by a laser diffraction particle size analyzer "HELOS" (manufactured by Sympatec GmbH) equipped with a wet-type disperser. Each of Toners 1 to 11 was added to the carrier so that the toner density is 6% by mass, the resultant material was charged into a micro-type V-type mixer (manufactured by TSUTSUI SCIENTIFIC INSTRUMENTS CO., LTD.), and mixed at a rotational speed of 45 rpm for 30 minutes, and developers 1 to 11 were prepared.

<Measurement of Charge Amount>

Developers 1 to 11 were placed between parallel plate (aluminum) electrodes while sliding, the charge amount and the mass of the toner at the time of development under the conditions that the electrode gap was 0.5 mm, the DC bias was 1.0 kV, the AC bias was 4.0 kV, and the frequency was 2.0 kHz were measured, and the charge amount per unit mass Q/m (μC/g) was taken as the toner charge amount. In this evaluation, 45 μC/g or more was accepted.

<Measurement of Sticking Force>

Figure 2:
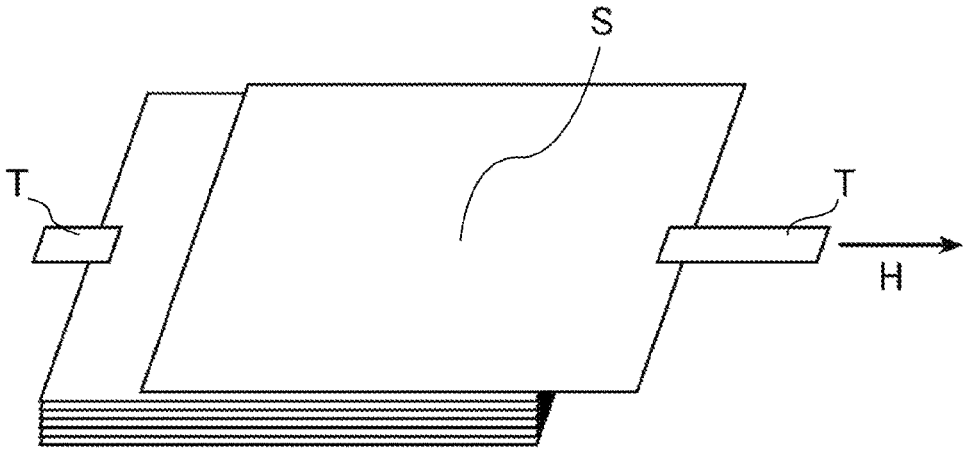
FIG. 2 is a schematic view illustrating the measurement of the sticking force.

Using "bizhub PRESS C1070 (manufactured by KONICA MINOLTA, INC. manufactured by)", the temperature of the lower roller (pressure roller 84 in FIG. 1) was set to 67° C., and a solid image (toner adhesion amount of 8.0 g/m$^2$) was output on both surfaces of five paper sheets (paper kind: OK TOPCOAT paper (manufactured by Oji Paper Co., Ltd.) A3, 157 g/m$^2$). 500 sheets of A3 J paper were placed on the output paper bundle and left to stand for 2 hours. The bundle of paper sheets was placed on a flat table, and tape T was attached on the tip of the uppermost sheet S, and the uppermost sheet S was slowly slid with the tape T in the horizontal direction H (see FIG. 2).

At this time, a second paper sheet from the top and the paper sheets below the second paper sheet were fixed to the table so as not to move. The force required to slide the paper sheet was measured with a spring scale. This measurement was repeated four times in order from the top, and the average value of the force indicated by the spring scale was taken as the sticking force. When the sticking force was 2.0 N or less, it was taken as a practical use level.

TABLE II

| Toner number | Volume resistivity [Ω · cm] 25° C. · 50% RH | Volume resistivity [Ω · cm] 67° C. | Toner charge amount [μC/g] | Sticking force [N] | Note |
|---|---|---|---|---|---|
| 1 | $2.1 \times 10^{15}$ | $7.7 \times 10^{14}$ | 51 | 1.5 | Present Invention |
| 2 | $4.4 \times 10^{14}$ | $1.3 \times 10^{14}$ | 48 | 1.3 | Present Invention |
| 3 | $2.4 \times 10^{15}$ | $9.6 \times 10^{14}$ | 51 | 1.9 | Present Invention |
| 4 | $4.5 \times 10^{15}$ | $9.7 \times 10^{14}$ | 52 | 1.7 | Present Invention |
| 5 | $1.4 \times 10^{14}$ | $1.3 \times 10^{14}$ | 45 | 1.3 | Present Invention |
| 6 | $4.5 \times 10^{15}$ | $9.9 \times 10^{14}$ | 53 | 1.9 | Present Invention |
| 7 | $3.0 \times 10^{16}$ | $1.6 \times 10^{16}$ | 55 | 8.0 | Comparative Example |
| 8 | $3.0 \times 10^{15}$ | $2.3 \times 10^{15}$ | 51 | 4.0 | Comparative Example |
| 9 | $9.6 \times 10^{15}$ | $5.4 \times 10^{15}$ | 53 | 5.0 | Comparative Example |
| 10 | $9.0 \times 10^{15}$ | $1.5 \times 10^{15}$ | 53 | 3.0 | Comparative Example |
| 11 | $9.7 \times 10^{13}$ | $9.5 \times 10^{13}$ | 43 | 1.1 | Comparative Example |

CONCLUSION

From Table II, according to the present invention, it was shown that a toner for electrostatic charge image development, which contains a crystalline resin but has favorable chargeability, and further can suppress the occurrence of electrostatic offset, can be provided.

Although embodiments of the present invention have been described and illustrated in detail, the disclosed embodiments are made for purposes of illustration and example only and not limitation. The scope of the present invention should be interpreted by terms of the appended claims.

What is claimed is:

1. A toner for electrostatic charge image development, comprising toner base particles including at least a binder resin, having a volume resistivity of $1.0 \times 10^{14}$ Ω·cm or more at 25° C. with 50% RH by a temperature change method, and having a volume resistivity of $1.0 \times 10^{15}$ Ω·cm or less at 67° C. by the temperature change method.

2. The toner for electrostatic charge image development according to claim 1, wherein the toner base particles contain a crystalline substance.

3. The toner for electrostatic charge image development according to claim 2, further comprising a crystalline polyester resin as the crystalline substance.

4. The toner for electrostatic charge image development according to claim 3, wherein the crystalline polyester resin is contained in the toner base particles within the range of 1 to 20% by mass.

5. The toner for electrostatic charge image development according to claim 1, wherein the toner base particles contain a release agent.

6. The toner for electrostatic charge image development according to claim 5, further comprising an ester-based wax as the release agent.

7. The toner for electrostatic charge image development according to claim 1, further comprising a styrene-acrylic resin as the binder resin.

8. The toner for electrostatic charge image development according to claim 1, wherein the content of sulfur element (S) as measured by X-ray analysis is within the range of 0.2 to 0.7 at %.

* * * * *